US005222886A

United States Patent [19]

Fischer et al.

[11] Patent Number: 5,222,886

[45] Date of Patent: Jun. 29, 1993

[54] CHEEK PLATE FOR A VANE PUMP

[75] Inventors: Günter Fischer, Gemünden; Horst Fischer, Lohr, both of Fed. Rep. of Germany

[73] Assignee: Mannesmann Rexroth GmbH, Lohr, Fed. Rep. of Germany

[21] Appl. No.: 854,569

[22] Filed: Mar. 20, 1992

[30] Foreign Application Priority Data

Mar. 20, 1991 [DE] Fed. Rep. of Germany ..... 4109149

[51] Int. Cl.[5] ..... F04C 2/344; F04C 15/04

[52] U.S. Cl. ..... 418/133; 418/179

[58] Field of Search ..... 418/133, 268, 82, 179

[56] References Cited

U.S. PATENT DOCUMENTS

| | | | |
|---|---|---|---|
| 2,820,417 | 1/1958 | Adams et al. . | |
| 2,826,179 | 3/1958 | Klessig et al. | 418/82 |
| 2,832,293 | 4/1958 | Adams et al. . | |
| 3,280,754 | 10/1966 | Marietta | 418/179 X |
| 3,752,609 | 8/1973 | Niemiec et al. . | |
| 3,964,844 | 6/1976 | Whitmore et al. | 418/133 |
| 4,505,654 | 3/1985 | Dean, Jr. et al. . | |
| 4,545,749 | 10/1985 | Sakamaki et al. | 418/179 X |
| 4,570,316 | 2/1986 | Sakamaki et al. | 418/179 X |
| 4,728,273 | 3/1988 | Linder et al. | 418/179 X |
| 5,044,908 | 9/1991 | Kawade | 418/179 |

FOREIGN PATENT DOCUMENTS 3726209 2/1988 Fed. Rep. of Germany ..... 418/179

*Primary Examiner*—Richard E. Gluck

*Attorney, Agent, or Firm*—Cushman, Darby & Cushman

[57] ABSTRACT

A cheek plate for a vane pump is provided which is made of an aluminum alloy. The cheek plate has a first or casing face which faces towards the casing of the pump when installed in the pump. A second or rotor face of the cheek plate faces the rotor when the cheek plate is installed in the pump. The cheek plate further includes a first radially outwardly located pressure control passage configuration, a second pressure control passage configuration located radially inwardly with respect to the first pressure control passage configuration. A first radially outwardly suction control passage configuration located diametrically opposite to the first pressure control passage configuration and a second suction control passage configuration located radially inwardly with respect to the first suction control passage configuration. The first and second pressure control passage configurations and the first and second suction control passage configurations extend between the casing face and the rotor face. At least the radially outwardly located pressure passage configuration includes at the rotor side a recess with connecting openings extending to the oppositely located casing face.

16 Claims, 4 Drawing Sheets

PRIOR ART

CHEEK PLATE FOR A VANE PUMP

DESCRIPTION

1. Technical Field

The present invention relates to a cheekplate for a vane pump.

2. Background Art

Cheek plates are generally associated with each side of the cam ring and the rotor of a vane pump allowing fluid flows to and from the rotor, such that a desirable pump operation is obtained. Preferably the fluid or pressure medium is an hydraulic oil. The cheek plates are made of metal and have preferably a circular cross section. Each cheek plate comprises, when installed, two frontal faces, one of which faces towards the casing of the pump (casing face) and the oppositely located one facing towards the rotor (rotor face). The rotor face is connected with the casing face by means of so called control slots which can be referred to in more general terms as control passages.

During operation, the vanes move along a cam curve or an internal contour formed by a cam ring or the stator of the pump itself. Said internal contour of the cam ring may be provided with single excentricity, thus requiring on the suction side two radially adjacent control passages and on the pressure side again two radially adjacent control passages. In case the internal contour is provided with double excentricity then twice the number of control passages has to be provided in said cheek plates.

Generally speaking, the cheek plates or control disks made of a steel, with the respective control passages or control slots being formed by machining. As a consequence, the manufacture of the cheek plates is relatively costly.

Specifically, attention is drawn to U.S. Pat. Nos. 4,505,654; 3,752,609; 2,832,293; 2,820,417.

It is an object of the present invention to design a cheek plate such that it can be manufactured at low cost. Specifically, fewer steps of manufacture are desirable without, however, having a negative influence on an efficient operation of the pump.

DISCLOSURE OF THE INVENTION

In one aspect of the present invention a cheek plate is provided which is made of an alloy of a light metal. Preferably, the cheekplate is made of an aluminum alloy.

It is preferred to manufacture the cheek plate of an aluminum alloy in a casting operation such that when casting the cheek plate the required control passages are already precisely formed, during the casting operation.

The present invention is specifically directed to the design of the radially outermost control passages through which the majority of the fluid flows. At least said radially outermost control passages are designed such that they do not extend completely or fully between the rotor face and the casing face. Each of said radially outer passages comprises on the rotor face of the cheek plate a recess having a depth smaller than the thickness of the cheek plate. Connecting means extend from the bottom of said recess to the casing side. Preferably said connecting means end in a common recess formed in said casing face of the cheek plate.

In another aspect of the present invention connecting channels are provided preferably at the rotor face of the cheek plate such that the radially outer control passage is connected preferably at both its ends with the respective radially inner control passage. Due to said connecting channels no pressure build-up can occur between said radially adjacent pressure control passages.

DESCRIPTION

Figure 1:
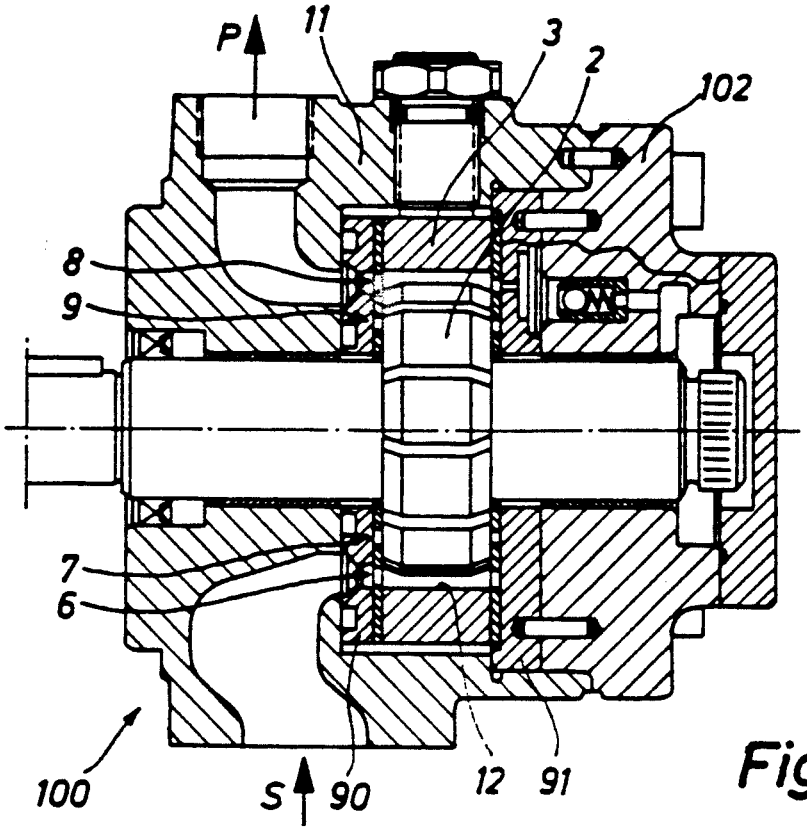
FIG. 1 is a diagrammatic longitudinal sectional view of a prior art vane pump.
Figure 2:
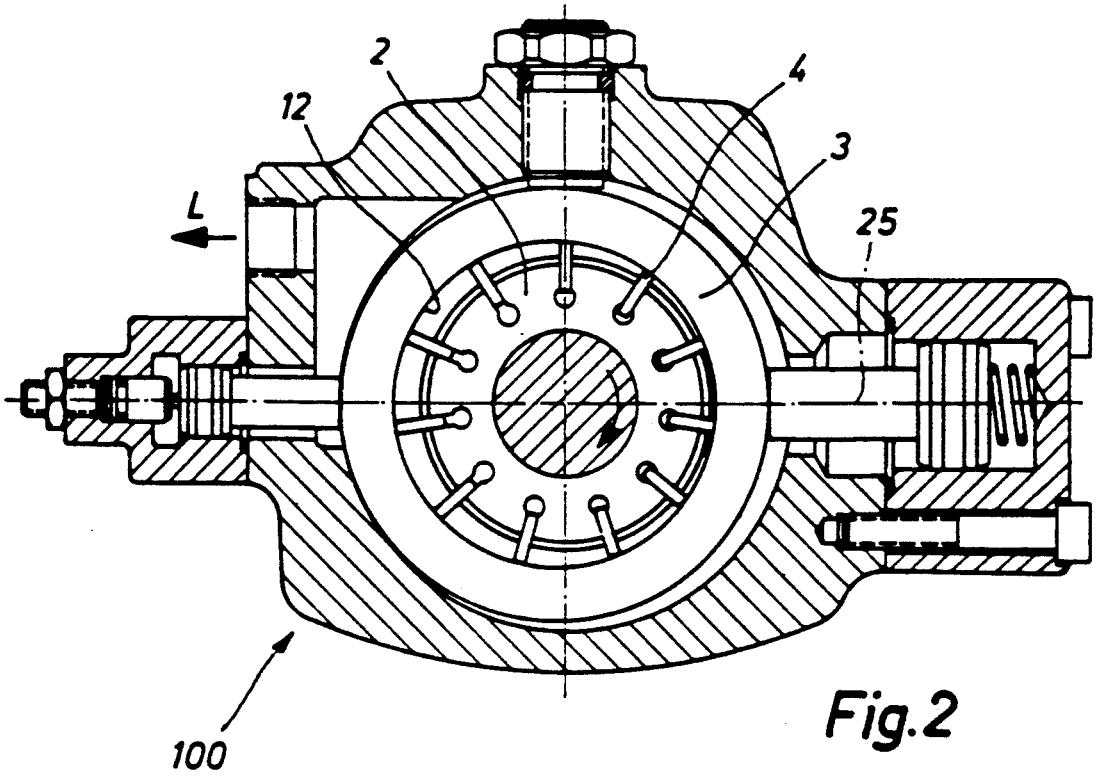
Fig.2 PRIOR ART
FIG. 2 is a diagrammatic cross sectional view of the vane pump of FIG. 1.
Figure 3:
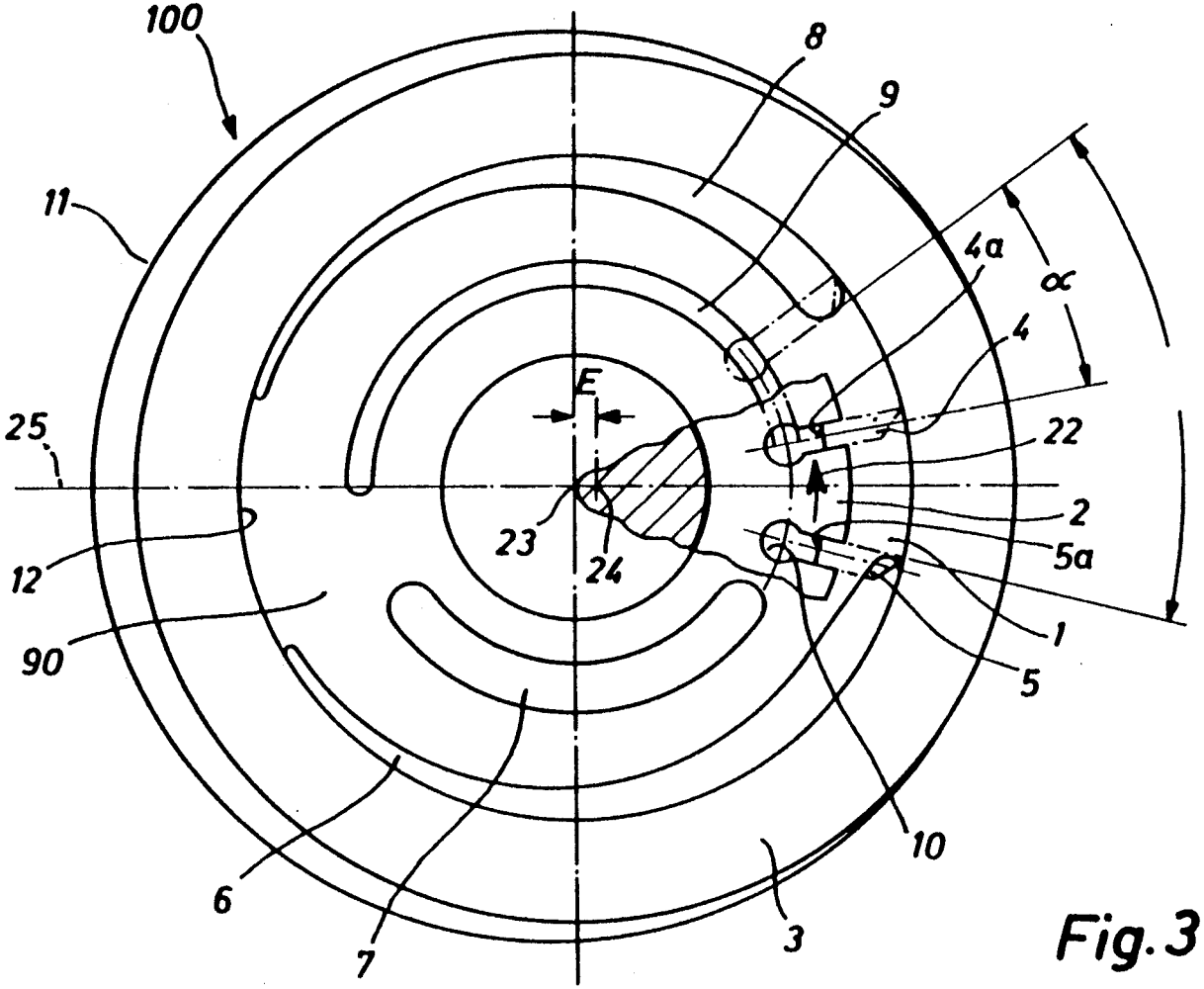
Fig. 3 PRIOR ART
FIG. 3 is a diagrammatic top plan view onto the rotor face of the cheek plate of FIG. 1.

Refering to FIGS. 1 to 3 there is shown a rotary sliding vane device or pump 100 as it is known in the prior art. The vane pump 10 comprises a casing 11 within which a cam ring 3 is located. The pump 100 comprises further a rotor 2 carrying a plurality of vanes 4, 5 adapted for cooperation with said cam ring 3. For this purpose the cam ring 3 has an internal contour or cam path 12, as it is shown in FIG. 3. In case the rotor 2 is rotated, then the radially movable vanes 4, 5 are urged outwardly and thus the outer tips of the vanes engage the inner contour 12 of cam ring 3 due to the centrifugal force and the system pressure behind said vanes.

Each two pairs of vanes, for instance the vanes 4 and 5 shown in FIG. 3, form together with the rotor 2, the cam ring 3 and two cheek plates 90, 91 working or pumping chambers, of which the pumping chamber 1 is shown. The two cheek plates 90, 91 are located sideways with respet to said rotor 2. The one cheek plate 90 is located on the side of the casing 11, while the other cheekplate 91 is located on the side of a cover 102 closing said casing 11.

In at least one of said cheek plates, in the embodiment shown, in the cheek plate 90, suction slots and/or pressure slots are provided. For the pump as shown in FIG. 1 to 3 two radially offset or spaced suction slots 6 and 7 and also two radially offset or spaced pressure slots 8 and 9 are provided. The pump as shown in FIG. 1 to 3 has an internal contour 12 which is of single excentric design, such that one pair of suction slots and one pair of pressure slots is sufficient. The pessure medium or fluid, for instance a hydraulic liquid is supplied via the suction slots 6 and 7 and the output of the pressure medium occurs via pressure slots 8 and 9. Generally speaking, the pressure and suction slots can be referred to as control slots. They will be referred to below, when describing the invention, as control passages.

The operating chambers like chamber 1 are adapted to cooperate with the suction slot 6 and the pressure slot 8, respectively. So called "under vane chambers" are formed adjacent to the bottom edges or tips 4*a* and 5*a* of said vanes and cooperate with the suction slot 7 and the pressure slot 9, respectively.

Preferably, the cam ring 3 is movably mounted within said casing 11 along the transversal axis 25 of the casing. The cam ring 3 can be moved from the position of maximum excentricity (as is shown) into a position having the excentricity zero. The excentricity is referred to in FIG. 3 with the letter E and is the distance between the center 23 of the rotor and the center 24 of the cam ring.

So as to initiate the pumping operation of the pump 100, the rotor 2 is rotated in the direction of the arrow 22 in FIG. 3. In the area of the suction slot 6 (and 7) the volume of the pumping chamber 1 is initially small, but increases with the continued rotation and is taking up pressure medium. When the pumping chamber 1 under consideration reaches its maximum size (largest distance between the cam contour 12 with respect to the center 23 of the rotor), the cheek plate 9 provides for the separation of the pumping chamber 1 with respect to the suction side and thus a connection is provided towards the pressure side. Due to the continued rotation and due to the design of the contour 12 the vanes 4, 5 are moved into their respective slots in the rotor, so that the volume of the pressure chambers is reduced and thus the liquid is urged to the pressure slot 8 (and similarly also to the pressure slot 9).

In the position shown in FIG. 3, the vane 5, is just separating a chamber 1 from the suction slot 6. The further rotation of the rotor 2 in the direction of arrow 22 reduces the volume of pressure chamber 1 and thus the pressure of the pressure medium in the chamber 1 increases. After rotation of the rotor 2 about an angle $\alpha$, vane 4 opens the connection of the pressure chamber 1 to the pressure slot 8.

Figure 5:
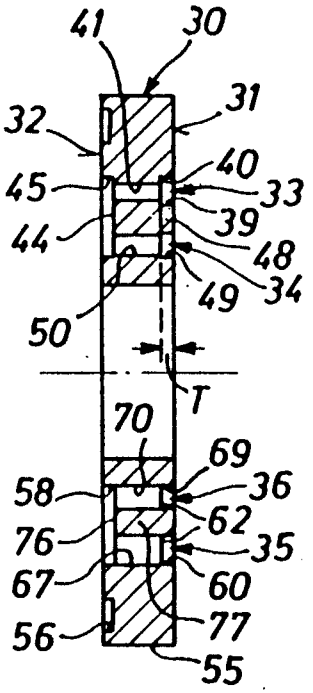
FIG. 5 is a cross sectional view through the cheek plate of FIG. 4.
Figure 4:
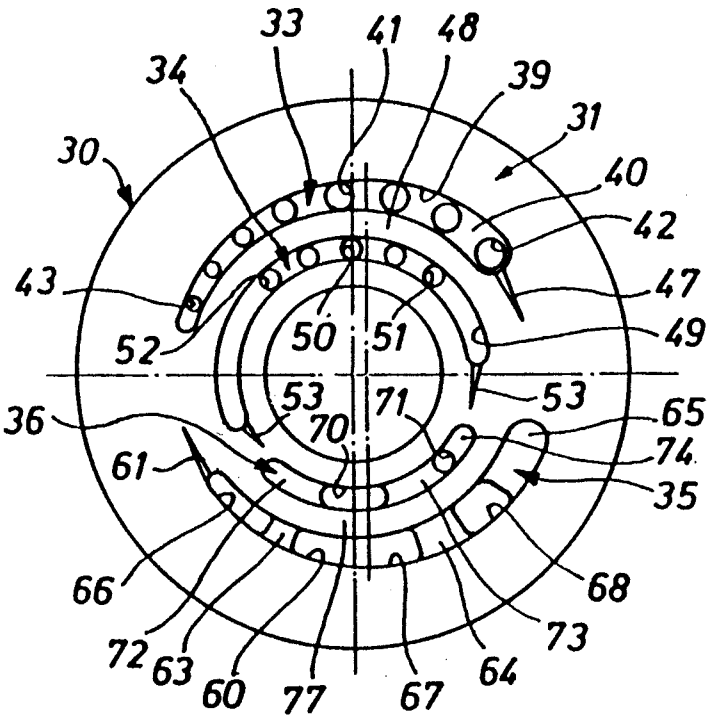
FIG. 4 is a top plan view onto the rotor face of a cheek plate of a first embodiment of the invention.

Following this general description of a vane pump 100 of the prior art, FIG. 4 to 6 relating to a first embodiment of a cheek plate 30 will now be described.

The cheek plate 30 as shown is of circular cross section and comprises, when located in the pump casing 11 and adjacent to the rotor 2 a rotor face 31 facing towards the rotor and opposite thereto a casing face 32 facing towards the casing. In accordance with the present invention, the cheek plate 30 is made of a light metal alloy, in particular an aluminum alloy and preferably by means of casting. Preferably, the casting operation is a (pressure) die-casting by means of which the cheek plate 30 is provided with control passages, yet to be described, for the pressure medium.

The rotor face or side 31 is connected with the casing face or side 32 by means of a first pressure control passage 33 and by means of a second pressure control passage 34 which is located radially inwardly with respect to said first pressure control passage 33.

Likewise, the rotor face 31 is connected with the casing face 32 by means of a first suction control passage 35 and by means of a second suction control passage 36 which is located radially inwardly with respect to said first suction control passage 35. In accordance with the present invention the passages 32, 34 35 and 36 are designed in a manner explained below.

The first pressure control passage 33 comprises an arcuate recess 39 having a depth T which is preferably constant. The recess 39 has, in a manner known per se a decreasing width as is shown in FIG. 4, so that a kidney shaped form is obtained. Openings or bores 41, 42 and 43 extend from the bottom 40 of said recess 39 to the casing face 32. Preferably, the openings 41, 42 and 43 end at the bottom 44 of another recess 45 formed in said casing face 32. In accordance with the kidney form of the recess 39 the openings 42, 41 and 43 have a decreasing diameter. Adjacent to the largest opening 42 said recess 39 forms a pointed pilot control grove 47.

The second pressure control passage 34 comprises a semicircular recess 49. From the bottom of said recess 49 openings or bores 50, 51 and 52 extend to the casing face 32. The recess 49 has preferably a constent width which is, in substance, not significantly larger than the diameter of said openings 50 to 52. The recess 49 is provided at its both ends with pilot control groves 53.

The openings 50 to 52 end at the side of the casing at the bottom 44 of the recess 45 already mentioned. Recess 45 has a correspondingly dimensioned radial width as is shown in FIG. 6 and is increasing preferably from the right towards the left. The housing face 32 is further provided with an annular groove 56 in its radially outer area and adjacent to an outer circumferal edge 55. It should be noted that the openings 50 to 52 are provided within an inner area of the recess 49, while said recess 49 continues to extend in an arcuate manner signifcantly beyond the two outermost bores 52 and 51.

The first suction control passage 35, located radially outwardly, extends from the rotor face 31 to the casing face 32 and comprises as the casing face for instance three indentations or recesses 57, 58 and 59, which extend (radially) at the casing face into an area of the second suction control passage 36.

The first suction control passage 35 comprises at the rotor face 31 a generally kidney shaped recess 60, as well as a pilot control grove 61. From the bottom 62 of said recess webs 63, 64 and 65 extend in the direction towards the casing face 32, defining channels 66, 67 and 68 for the passage of fluid. Preferably, the channels 66, 67 and 68 have the cross section as is shown in FIGS. 4 and 6.

The second suction control passage 36 comprises at the rotor face 31 a recess 69, the bottom of which is also referred to by reference numeral 62. Said recess 69 has preferably a constant width and extends in circumferential direction about an angle which is somewhat smaller than the angle about which the recess 60 extends. A substantially oval shaped channel 70 and an opening 71 connect the rotor face 31 with the housing face 32 forming webs 72, 73 and 74.

At the bottom of the recesses 57, 58 and 59 are the ends 76 of a separating wall 77 between the first and second suction control passages 35, 36.

Figure 6:
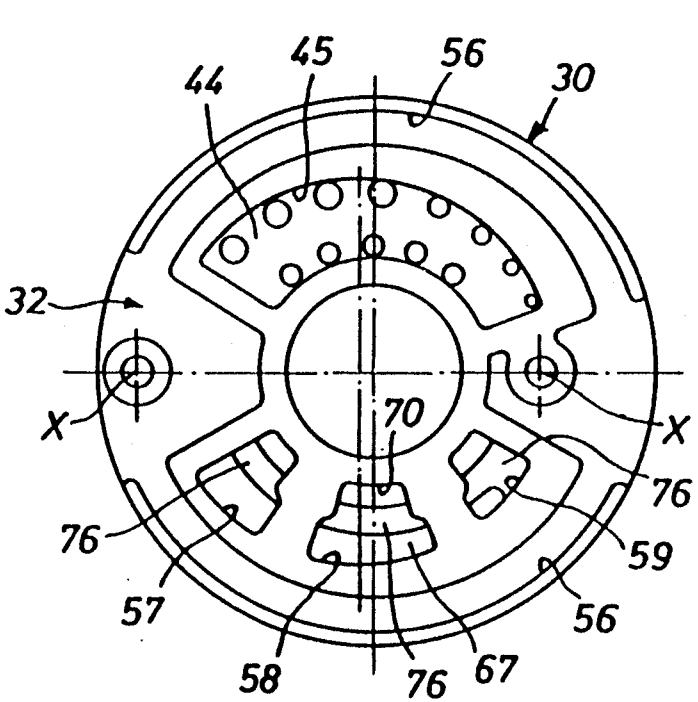
FIG. 6 is a top plan view of the casing face of the cheek plate of FIG. 5.
Figure 7:
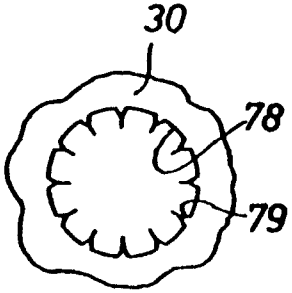
FIG. 7 is a plan view of a detail X in FIG. 6.
Figure 8:
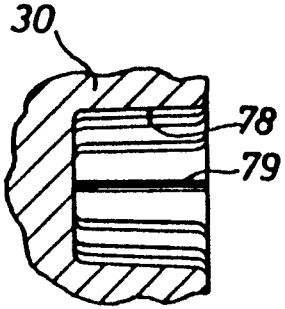
FIG. 8 is a cross sectional view of the detail of FIG. 7.

FIGS. 7 and 8 disclose a detail of what is shown at X in FIG. 6, i.e. the design of two positioning bores 78. Each positioning bore 78 is provided such that when mounting the cheek plate 3 at the casing a misalignment between a pin fixed in the casing and the bores 78 is compensated for by the plastic deformation of the protruding or pointed parts 79 formed by said bores 78. Thus, under all circumstances a secure fixation of the cheek plate 30 is obtained.

Figure 11:
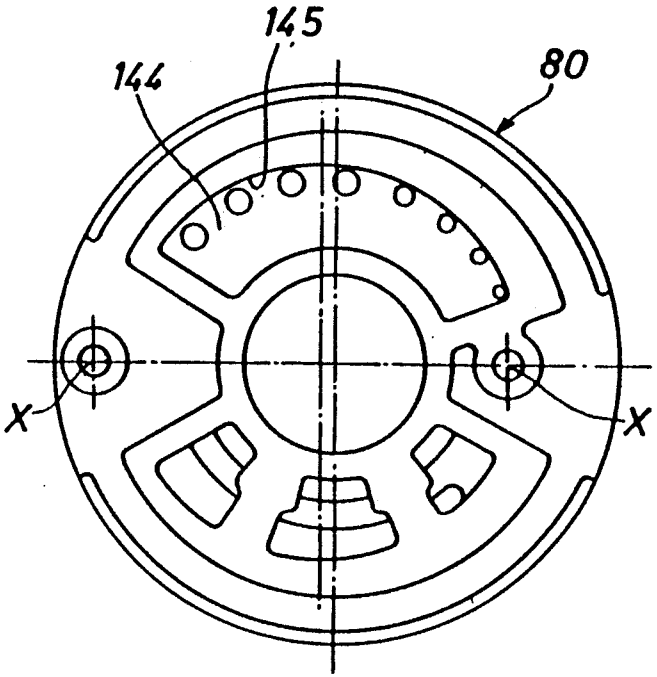
FIG. 11 is a top plan view of the casing face of the cheek plate of the second embodiment.
Figure 10:
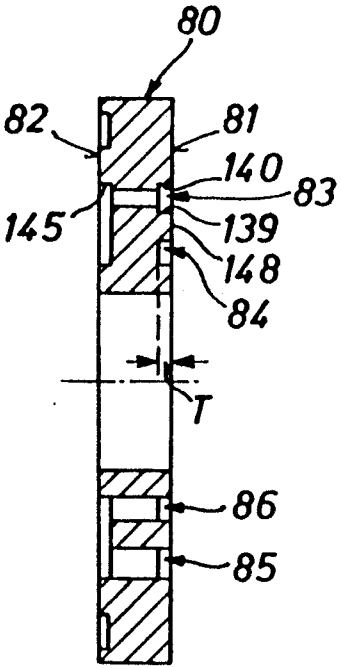
FIG. 10 is a cross sectional view of the cheek plate of FIG. 9.
Figure 9:
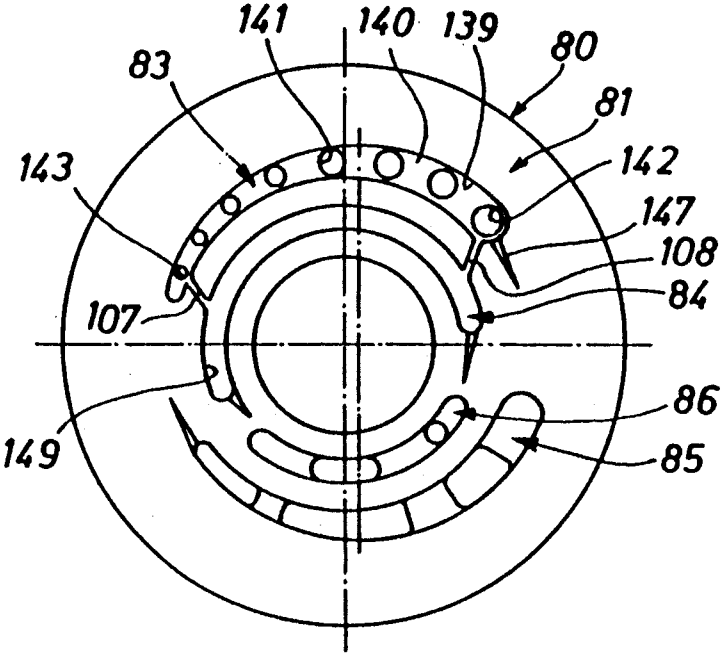
FIG. 9 is a top plan view of the rotor face of cheek plate in accordance with a second embodiment of the invention.

In accordance with a second embodiment of the invention shown in FIGS. 9 to 11 the arcuate recesses 139 and 149 on the rotor face are connected by channel means. In the disclosed embodiment said channel means comprise two channels 107 and 108 which are preferably located close to the end of said recess 139. By means of said channels a pressure build-up, which might occur, can be equalized. Preferably, said channels 107 and 108 are in the area of the outermost bores 143 and 142 of said first pressure control passage 83. Said channels 107 and 108 end preferably in said recess 149 at locations somewhat distant from the respective ends of said recess 149 in circumferential direction (see FIG. 9).

We claim:

1. A cheek plate for a vane pump, said cheek plate being made of an aluminum alloy and comprising:

a first or casing face which faces towards the casing of the pump when said cheek plate is installed in said pump, a second or rotor face located opposite to said casing face and facing towards the rotor of the pump when said cheek plate is installed in said pump, first radially outwardly located pressure control passage means (33; 83), second pressure control passage means (34; 84) located radially inwardly with respect to said first pressure control passage means, first, radially outwardly located suction control passage means (35; 85) which are diametrically opposite to said first pressure control passage means, second suction control passage means located radially inwardly with respect to said first suction control passage means, said first and second pressure control passage means and said first and second suction control passage means extending between said casing face and said rotor face, wherein at least said radially outwardly located pressure passage means comprises, at least at the rotor face (31, 81), a recess (39, 49, 60, 69, 70; 139, 149) and opening means (41–43; 51–52; 70, 71; 141, 142) extending to the oppositely located casing face (32, 82).

2. The cheek plate of claim 1, wherein the depth (T) of said recess (39) is relatively small.

3. The cheek plate of claim 2, wherein the depth (T) of said recess is smaller than one quarter of the thickness of the cheek plate.

4. The cheek plate of claim 1 having a circular cross section.

5. The cheek plate of claim 1, wherein the casing face is provided with at least one opening (78) surrounded by inwardly protruding pointed parts.

6. The cheek plate of claim 1, wherein said opening means connecting said recess (39) on the rotor face (31) to the casing face (32) includes a recess (45) provided in said casing face.

7. The cheek plate of claim 1, wherein the suction control passage means comprise a plurality of channel means, each extending in circumferential direction over a distance which is larger than the radial width of said suction control passage means.

8. The cheek plate of claim 6 wherein the recess in the rotor face and the recess in the casing face have the same depth (T).

9. The cheek plate of claim 8, wherein the depth of said recesses is about one fifth of thickness of the cheek plate.

10. The cheek plate of claim 1, wherein said recess is kidney shaped such that it has a width which decreases in one circumferential direction.

11. The cheek plate of claim 1, wherein said radially inwardly located pressure passage means comprises at least at the rotor face a recess, the recess has a constant width.

12. The cheek plate of claim 1, wherein each of said pressure control passage means comprise connecting openings of circular cross section.

13. The cheek plate of claim 1, wherein connecting channels are provided for connecting on the rotor face the first and second pressure control passage means, so as to provide for a pressure balance.

14. The cheek plate of claim 13, wherein said connecting channels (107, 108) are provided in the area of the ends of the recess (139) of the first pressure control passage means.

15. A cheek plate for a vane pump made of a cast aluminum alloy, said cheek plate comprising:

a first or casing face and a second or rotor face between which pressure passage means said pressure passage means comprising within about the same angular location first pressure control passage means located radially outwardly and second pressure control passage means located radially inwardly, said suction control passage means comprising in about the same angular area first suction control passage means located radially outwardly and second suction passage control means located radially inwardly, wherein said first pressure control passage means comprises a recess (39) in the rotor face, said recess defining a bottom (40) from which a plurality of opening means extended to said casing face which is provided with a recess, at the bottom of which said opening means are ending.

16. A cheek plate for a vane pump made of a cast aluminum alloy, said cheek plate comprising:

a first or casing face and a second or rotor face between which pressure passage means and suction passage means extend, said pressure passage means comprising within about the same angular location first pressure control passage means located radially outwardly and second pressure control passage means located radially inwardly, said suction control passage means comprising in about the same angular area first suction control passage means located radially outwardly and second suction passage control means located inwardly, wherein said first pressure control passage means comprises a first recess (39) in the rotor face, said first recess defining a bottom (40) from which a plurality of opening means extend to said casing face which is provided with a second recess, at the bottom of which said opening means terminate, and wherein said second pressure control passage means comprises a circumferentially extending third recess extending in said rotor face, and wherein further connecting means are provided between said first recess of the first pressure control passage means on the rotor face and said circumferentially extending third recess.

* * * * *